356-153 SR
6/30/87 OR 4,676,636

United States Patent [19]

Bridges et al.

[11] Patent Number: 4,676,636

[45] Date of Patent: Jun. 30, 1987

[54] ALIGNMENT AID FOR GUN MUZZLE REFERENCE SYSTEM

[75] Inventors: John A. Bridges, Egham; Kenneth E. Young, Walton-on-Thames, both of England

[73] Assignee: The Secretary of State for Defence in Her Britannic Majesty's Government of the United Kingdom of Great Britain and Northern Ireland, London, England

[21] Appl. No.: 795,273

[22] Filed: Nov. 5, 1985

[30] Foreign Application Priority Data

Nov. 19, 1984 [GB] United Kingdom ..... 8429201

[51] Int. Cl.[4] ..... G01B 11/27

[52] U.S. Cl. ..... 356/153; 356/154; 33/286

[58] Field of Search ..... 33/286; 356/138, 140, 356/144, 153, 154

[56] References Cited

U.S. PATENT DOCUMENTS 3,684,383 8/1972 Johansson ..... 356/154
4,142,799 3/1979 Barton ..... 356/153

*Primary Examiner*—Eugene R. LaRoche
*Assistant Examiner*—Steven J. Mottola
*Attorney, Agent, or Firm*—Stevens, Davis, Miller & Mosher

[57] ABSTRACT

An alignment aid for use in installing a reference system of known type which reflects an image of an indicator mark mounted on a gun turret, back into the gun sight via a mirror mounted at the muzzle end of the gun barrel, for comparison with a reference mark on the graticule of the gunsight, thereby to indicate any angular deviation between the muzzle axis and the gunner's line of sight. The alignment aid, which is used in setting the mirror to provide initial coincidence between the indicator mark image and the reference mark, consists of a highly reflective viewing screen attachable to the turret adjacent the indicator mark, and a projection lamp attached to the gun sight so as to protect an image of the reference mark onto the screen, via the telescopic optics of the gunsight and the mirror.

6 Claims, 4 Drawing Figures

ALIGNMENT AID FOR GUN MUZZLE REFERENCE SYSTEM

This invention relates to apparatus for assisting in the initial alignment of a muzzle reference system.

Muzzle reference systems are well-known for use with ordnance, in particular vehicle mounted guns, to provide indication of angular deviation of the gun muzzle axis from the optical axis of the associated gun sighting system, and thereby to permit correction of potential sighting errors. Significant misalignment between these two axes can occur in large guns when the temperature of the gun barrel rises non-axisymmetrically, e.g. when the gun is fired in a chilling crosswind, causing barrel bending.

These muzzle reference systems all basically depend upon mounting a reflector on the gun muzzle so as to reflect back onto the graticule of the gunsight, for comparison with a reference mark thereon, a beam of light emanating from an indicator mark located on the gun mounting adjacent the sight in substantially the same transverse plane.

An essential step in the installation and alignment procedure for such systems is to set the reflector at the correct disposition for directing the reflected image of the indicator mark into coincidence with the reference mark. Once this step is accomplished, any subsequent non-coincidence of the image of the indicator mark with the reference mark is indicative of the extent of muzzle axis deviation contemporaneously prevailing. The setting procedure has to be repeated every time a barrel is changed, which may well take place in the field under extremely adverse conditions. Currently used procedure requires two technicians, the first located at the muzzle to make the adjustments and the second viewing the image at the gun sight so as to call setting instructions to the first. Frustrating and time consuming difficulties can be encountered in this procedure both initially in directing the image to fall upon any region whatsoever of the graticule, particularly in daylight conditions, and subsequently in achieving coincidence with the specific reference mark.

The present invention seeks to provide an alignment aid for enabling the correct reflector setting to be more readily achieved.

Accordingly, the present invention is an alignment aid for use with a muzzle reference system for a mounted gun having a telescopic gun sight: the muzzle reference system being of a known type including an indicator mark located on the gun mounting in fixed operative relationship with the gun sight and a reflector adjustably mounted upon the gun muzzle for reflecting an image of the indicator mark back into the gunsight, which gunsight is provided with an object lens, a graticule having a reference mark, an eye piece lens, a primary exit pupil from which the graticule is viewed, and an auxiliary optical system for focusing the image of the indicator mark onto the graticule having an auxiliary exit pupil located within the primary exit pupil; alignment of the system being achieved by setting the reflector to a disposition providing coincidence between the image and the reference mark: wherein the alignment aid comprises a viewing screen superimposable upon the indicator mark so as to confront the reflector, and a light source attachable to the gunsight so as to be located at the auxiliary exit pupil thereby to cause a focused image of the reference mark to be projected onto the viewing screen via the gun sight and the reflector.

In effect, the optical components of the telescopic gunsight are used in reverse order to provide a slide projector, the eyepiece lens serving as a condenser, the graticule serving as a slide and the combined auxiliary optical system and object lens serving as a projection lens.

Use of the alignment aid permits selection of the required reflector disposition by a single technician located at the muzzle and directly viewing the results of his adjustments to the reflector upon the viewing screen.

Preferably the viewing screen is highly reflective so that adjustments can be made under high ambient light conditions and a front surface coating of a retro-reflective material, eg an exposed lens matrix, is particularly effective. As the observation angle for the operator is extremely narrow, typically about 3°, a coating of small angle retro-reflectivity having the advantage of a high luminescence factor within that angle can be employed.

An embodiment of the invention will now be described by way of example only with reference to the accompanying drawings of which FIG. 1 is a functional representation of a typical muzzle reference system in use, FIG. 2 is the relevant portion of view seen in the gun sight of FIG. 1.

Figure 1:
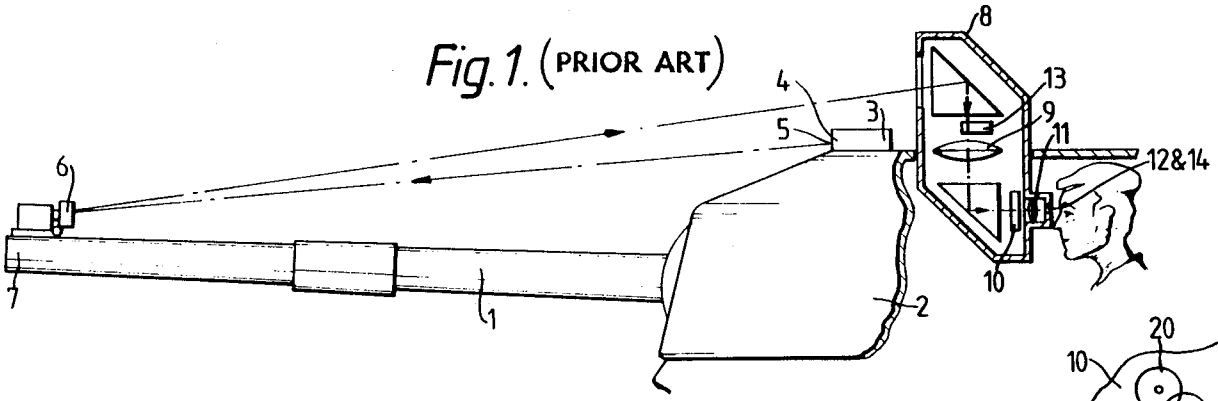
Fig. 1. (PRIOR ART)

As shown in FIG. 1, a gun barrel 1 and a gun turret 2 are fitted with a conventional muzzle reference system comprised by a light source housing 3 having an adjustably disposed front face 4 which is apertured to provide an illuminated indicator mark 5, and a mirror 6 adjustably mounted at the muzzle end 7 of the gun barrel 1 so as to direct an image of the indicator mark 5 into a telescopic gunsight 8. The gunsight 8 has an object lens 9, a graticule 10, an eyepiece lens 11 and a primary exit pupil 12 from which the primary field of view of the gunsight together with the superimposed graticule 10 is viewed. Located within a cross-sectional part of the primary light path is an auxiliary optical system 13 for directing a focused image of the indicator mark 5 on to the graticule 10, the image being viewable at an auxiliary exit pupil 14 located within the primary exit pupil 12.

Figure 2:
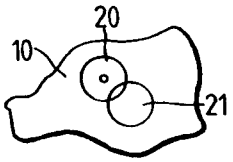
Fig. 2. (PRIOR ART)

The graticule 10 is provided with a reference mark 20, as illustrated in FIG. 2, which Figure depicts the relevant detail of a gunner's view of the graticule 10 from the exit pupils 12 and 14. Superimposed upon the graticule 10 is a focused image 21 of the indicator mark 5, which image is arranged to be coincident with the reference mark 20 during installation of the system by appropriate adjustment of the mirror 6 and the indicator mark 5. Provided that the disposition of the mirror and the indicator mark are correctly selected, any subsequent lack of coincidence between the image and the mark, such as that depicted here, is indicative of the extent of misalignment between the muzzle axis and line of sight due to prevailing barrel bend.

Figure 3:
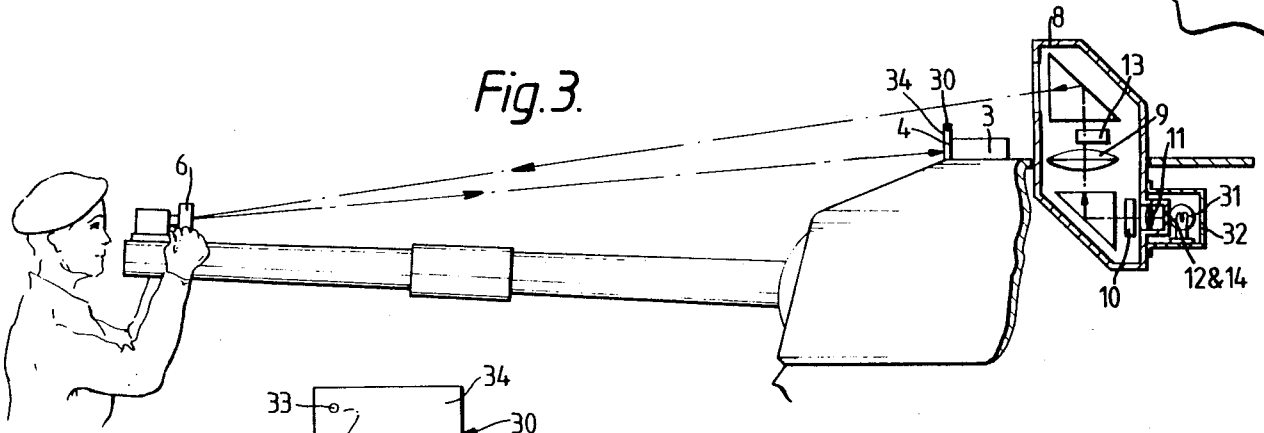
FIG. 3 is the same muzzle reference system fitted with an alignment aid.
Figure 4:
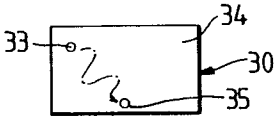
FIG. 4 is the view seen by the adjustment technician in FIG. 3.

Selection of the correct mirror disposition is illustrated in FIG. 3, which depicts use of an alignment aid comprising a viewing screen 30 attached to the light source housing 3 so as to cover the front face 4 and to extend radially therefrom, and a projection lamp 31 contained in a lamp housing 32 attached to the gun sight 8 so as to be located at the auxiliary exit pupil 14, thereby to project a focused image 33 (see FIG. 4) of the reference mark 20 on to the viewing screen 30 via the gunsight optics and the mirror 6.

The reflecting face of the screen 30 is coated with a layer 34 of a high contrast retro-reflective sheeting, Scotchlite 7615 (Registered Trade Mark) for example, and is provided with an alignment mark 35 which is disposed in registration with the now obscured indicator mark 5.

The disposition of the mirror 6 is varied by the adjustment technician until the image 33 of the reference mark 20 becomes coincident with the alignment mark 35 and hence substantially with the obscured indicator mark 5. The mirror 6 is then clamped and the projection lamp 31 and screen 30 removed. The reference mark 20 and the image 21 of the indicator mark 5 can then be conjointly viewed in the gunsight and any remaining non-coincidence removed by final fine adjustment of the indicator mark 5, ie by adjusting the disposition of the front face 4 of the light source housing 3. The muzzle reference system is then ready for use.

It will be apparent to those skilled in the art that the alignment aid will function equally well with more complex muzzle reference systems than the basic system described here. For example, systems employing additional optical components such as a collimator, e.g. GB 1585714, for extending the light paths of the system to a length commensurate with the dimensions of specific gun mountings, can be similarly aligned with advantageous use of the aid.

We claim:

1. An alignment aid for use with a muzzle reference system for a mounted gun having a telescopic gun sight: the muzzle reference system being of a known type including an indicator mark located on the gun mounting in fixed operative relationship with the gun sight and a reflector adjustably mounted upon the gun muzzle for reflecting an image of the indicator mark back into the gunsight, which gunsight is provided with an object lens, a graticule having a reference mark, an eye piece lens, a primary exit pupil from which the graticule is viewed, and an auxiliary optical system for focusing the image of the indicator mark onto the graticule having an auxiliary exit pupil located within the primary exit pupil; alignment of the system being achieved by setting said reflector to a disposition providing coincidence between said image and said reference mark: wherein the alignment aid comprises a viewing screen superimposable upon said indicator mark so as to confront said reflector, and a light source attachable to said gunsight so as to be located at said auxiliary exit pupil thereby to cause a focused image of said reference mark to be projected onto said viewing screen via said gun sight and said reflector.

2. An alignment aid as claimed in claim 1 wherein said indicator mark is illuminated.

3. An alignment aid as claimed in claim 2 wherein said indicator mark is provided by a light source housing having an apertured front face.

4. An alignment aid as caimed in claim 3 wherein said apertured front face is adjustably disposed.

5. An alignment aid as claimed in claim 1 wherein said viewing screen has a retro-reflective surface coating.

6. An alignment aid as claimed in claim 1 wherein said viewing screen is provided with an alignment mark disposable in registration with said indicator mark.

* * * * *